United States Patent [19]

Trümper

[11] 4,389,073

[45] Jun. 21, 1983

[54] APPARATUS FOR USE WITH CUTTING DRUMS OF MINERAL MACHINES

[75] Inventor: Thomas Trümper, Werne, Fed. Rep. of Germany

[73] Assignee: Gewerkschaft Eisenhutte Westfalia, Lunen, Fed. Rep. of Germany

[21] Appl. No.: 246,135

[22] Filed: Mar. 23, 1981

[30] Foreign Application Priority Data

Mar. 26, 1980 [DE] Fed. Rep. of Germany ..... 3011583

[51] Int. Cl.[3] ..... E21C 35/20

[52] U.S. Cl. ..... 299/45; 192/18 A

[58] Field of Search ..... 299/45; 192/12 C, 18 A

[56] References Cited

U.S. PATENT DOCUMENTS 3,595,353 7/1971 Beneke ..... 192/18 A

FOREIGN PATENT DOCUMENTS 2652614 5/1978 Fed. Rep. of Germany ..... 299/45

1409268 10/1975 United Kingdom ..... 299/45

*Primary Examiner*—Ernest R. Purser

*Attorney, Agent, or Firm*—Thompson, Birch, Gauthier & Samuels

[57] ABSTRACT

A rotatable cutting drum of a mineral mining machine is supported by a pivotable arm and is operably associated with a blade or the like which is positionable to assist in loading mineral detached by the drum. The blade is carried on a ring-like support which is itself mounted for pivoting about the axis of the drum to position the blade. Apparatus serves to couple the blade and its support selectively to the drum when it is desired to re-position the blade so that the latter moves around the axis of rotation of the drum with the drum itself. The apparatus is composed of piston and cylinder units provided in the blade support. The piston rods of these units extend outwardly from either side of the blade support and carry first and second abutment or friction rings. These respective friction rings either couple the blade support to the arm supporting the drum or to the drum. Hydraulic fluid is admitted to the units to bring the associated first friction ring into contact with the drum when the blade is to be re-positioned. The hydraulic force is opposed by restorative spring force which biases the pistons of the units so that the second friction ring normally clamps the blade support to the arm supporting the drum.

9 Claims, 2 Drawing Figures

APPARATUS FOR USE WITH CUTTING DRUMS OF MINERAL MACHINES

BACKGROUND TO THE INVENTION

The present invention relates in general to cutting drums of mineral mining machines and more particularly to apparatus for use with such drums.

It is known to mount the rotatable cutting drums of mineral winning machines on pivotable arms which can be raised or lowered in relation to the bodies of the machines to bring the drums into different working positions. It is also known to employ a cowl or blade, possibly of arcuate shape, which is positioned adjacent the periphery of such a cutting drum to assist in loading the mineral detached from a mineral face by the drum. With such an arrangement it is however necessary to re-position the blade depending on the direction of movement of the machine. Normally the blade is mounted on a support ring or the like which can be moved around the axis of rotation of the drum to re-position the blade. It is known from German patent specification No. 2 652 614 to provide apparatus in the form of double-acting hydraulic piston and cylinder units in the blade support ring which can be actuated to press a friction ring against the drum. In this way the blade and its support can be selectively coupled to the drum through the friction ring to move the blade about the axis of rotation of the drum as the latter rotates to re-position the blade. In order to release the friction ring coupling to free the blade from the drum, it is necessary to charge the units with pressure fluid in the opposite direction. The prior art arrangement also describes means for locking the blade in its desired position with the aid of a hydraulic friction brake which permits the blade to swivel should excessive loading force be encountered. The prior art apparatus is complex and relatively costly to construct and moreover should a fault occur in the hydraulic fluid supply the apparatus will be unusable. A general object of the present invention is to provide an improved form of apparatus of the known type for selectively coupling the blade to the drum.

SUMMARY OF THE INVENTION

Apparatus constructed in accordance with the invention serves to selectively couple a blade support to the rotatable cutting drum of a mineral winning machine. The apparatus itself comprises hydraulic piston and cylinder units connected to friction means drivably engageable with the drum. Spring means biases the units to maintain the friction means released from the drum and hydraulic fluid can be admitted to the units to oppose the biasing force of the spring means and urge the friction means into driving contact with the drum. In this way hydraulic force can be used solely to couple the blade support to the drum when re-positioning is desired. It is preferable to provide first and second friction means connected to through-passing piston rods at the opposite ends of the latter. The spring means can then hold the first friction means against the drum support to clamp the blade and its support thereto. The hydraulic force then acts to release the first friction means and couples the second friction means to the drum.

The friction means can take the form of rings which are engageable to similar surfaces, e.g. formed by flanges on the drum support and on the drum. Preferably, these rings are of similar or identical construction and are detachably connected to the piston rods to permit their replacement or their interchangement.

The piston and cylinder units can be located at least partly within the blade support which can conveniently itself be of ring-like configuration. Compression springs providing the biasing force can be located inside the units to bear directly on the pistons thereby providing a protective location for the springs.

In contrast to the known arrangement apparatus constructed in accordance with the invention is simpler in design. The springs which provide the clamping force ensure the blade is held reliably in its operating position while permitting its displacement should the blade or its support be subjected to overloading. Moreover, the arrangement is fail-safe in that the blade is clamped at all times unless hydraulic fluid is fed into the working chambers of the piston and cylinder units. To re-position the blade, it is only necessary to provide hydraulic pressure for a relatively short time.

As will become apparent hereinafter the present invention also provides a mineral winning machine provided with a cutting drum supported for rotation on a pivotable support member, a blade which serves to assist in the loading of mineral detached by the drum, a support for the blade which is pivotable about the axis of rotation of the drum to position the blade in relation to the drum, piston and cylinder units formed at least partly within the blade support, the units having pistons and piston rods projecting outwardly from the pistons toward both the drum support member and the drum, rings provided at the ends of the piston rods, springs in the units which bias the pistons to bring one of the rings into clamping contact with the drum support member while the other ring is free from contact with the drum and working chambers in the units which serve to receive hydraulic pressure fluid which acts to displace the pistons against the force of the springs to free the one ring from the drum support and cause the other ring to drivably engage with the drum so that the drum will move the blade support about the rotational axis of the drum to re-position the blade.

The invention may be understood more readily, and various other features of the invention may become apparent, from consideration of the following description.

BRIEF DESCRIPTION OF DRAWINGS

An embodiment of the invention will now be described, by way of example only, with reference to the accompanying drawing, wherein.

DESCRIPTION OF PREFERRED EMBODIMENT

Figure 1:
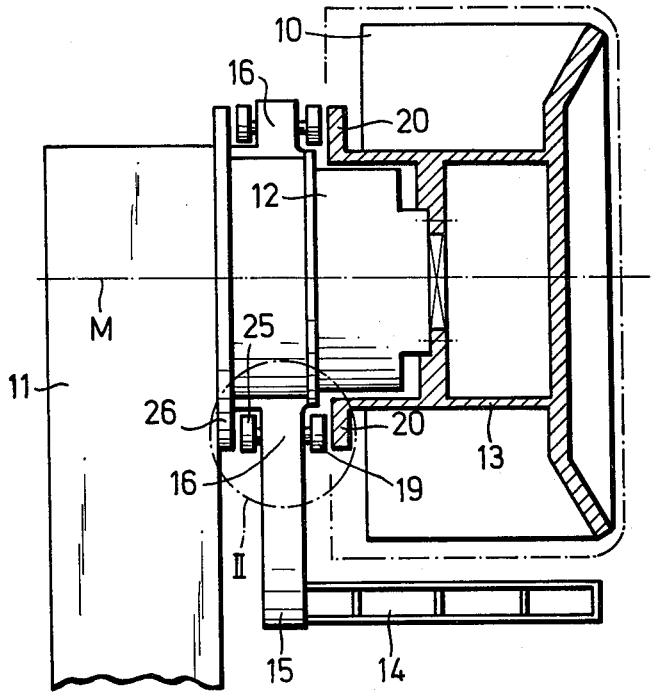
FIG. 1 is a diagrammatic representation of a cutting drum of a mineral winning machine provided with apparatus constructed in accordance with the invention.

As shown in FIG. 1 of the drawing, a cutting drum 10 of a mineral winning machine is mounted for rotation about an axis M. The drum 10 is equipped with cutters and is driven about the axis M to win mineral, e.g. coal, from a mineral face, not shown, as known per se. The drum 10 can be mounted and supported on the body or drive motor of the machine but as depicted it is preferable to mount the drum 10 on a support member 11 such as an arm, which is itself movable in relation to the machine body. The support member 11 can be pivotably mounted to the machine body so that the support member 11 can be swung up or down to make the drum 10 operate over different regions of the mineral face. The support member 11 can be hollow to accommodate the drive means for driving the drum 10 or at least gearing which transmits the drive to the drum 10. As depicted in FIG. 1, the drum 10 is formed with a hub 13 in which planetary gearing 12 is located and through which rotary drive is imparted to the drum 10.

As is known a blade or cowl 14 which may be of arcuate shape is attached to a support 15 which can be pivoted about the axis M. The blade 14 can thus be selectively positioned adjacent a portion of the external periphery of the drum 10 and serves to strip and guide the detached mineral thereby generally assisting its loading. Normally the machine would be moved back and forth alongside the mineral face while the drum 10 is made to operate over different regions of the face on successive, i.e. the so-called uphill and downhill, runs. As the support member 11 is raised or lowered and when the machine reverses its direction of travel the blade 14 is also to be adjusted in position. As is known this can be accomplished by selectively coupling the blade 14 to the drum 10 so that the blade 14 will move with the drum 10 about the axis M to its new location normally involving displacement of the support 15 through 180°. The apparatus described hereinafter is designed to achieve this selective coupling.

Figure 2:
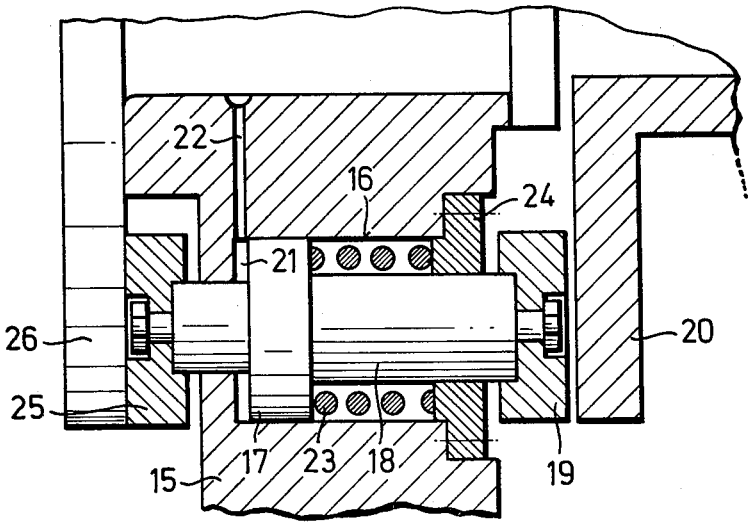
FIG. 2 is a detailed sectional side view of part of the apparatus indicated by reference II in FIG. 1.

As shown in FIGS. 1 and 2, the support 15 is provided internally with a plurality of hydraulic piston and cylinder units 16. Conveniently, the support 15 is ring-shaped and the units 16 are distributed uniformly around the support 15 in positions which lie on a circle described from the axis M. Each unit 16 has a central piston 17 in its cylinder and a piston rod 18 which passes through the cylinder to project outwardly from both ends. A coupling or abutment ring 19, preferably formed with a friction-type brake face lining, is mounted to the rods 18 of the units 16 adjacent the drum 10 and more particularly adjacent a flange 20 thereof. The ring 19 can be brought into frictional contact with the flange 20 when it is desired to adjust the position of the blade 14. The other ends of the rods 18 of the units 16 remote from the drum 10 are likewise attached to a clamping or abutment ring 25 preferably also provided with a friction-type brake lining which engages on a region 26 such as a flange on the support 11. The rings 19, 25 can be of identical construction and detachably connected to the rods 18 so they can be interchanged or replaced. As shown in FIG. 2, the cylinders of the units 16 are provided wholly within the support 15 to slidably receive the associated pistons 17. Bores or channels 22 are provided in the support 15 to permit hydraulic pressure fluid to be fed into or taken from working chambers 21 in the units 16. Fluid fed into the chambers 21 will force the pistons 17 to the right hand side thereby to cause the ring 19 to be pressed against the flange 20. The piston rods 18 are slidably received within bores in end walls of the cylinders of the units 16. The end walls adjacent the ring 25 are part of a common wall of the support 15 and the bores are sealed against the rods 18 to ensure no loss of pressure fluid. The end walls adjacent the ring 19 are in contrast formed by detachable closure members 24. Compression springs 23 are provided in the units 16 to bias the pistons 17 away from the members 24 to the left hand side. For convenience FIG. 1 shows both the rings 19 and 25 free from engagement with the flanges 20, 26 but FIG. 2 shows the normal arrangement where the springs 23 act on the pistons 17 to bias the pistons 17 and press the ring 25 against the flange 26. In this case, the blade 14 is locked in position while the drum 10 rotates but abnormal loading forces can overcome the clamping force to permit the blade 14 to move. When it is desired to re-position the blade 14 on reversal of the direction of motion of the machine the pressure chambers 21 are subjected to pressure fluid to urge the pistons 17 to the right against the restoring force of the springs 23 thereby releasing the ring 25 and pressing the ring 19 against the flange 20 so that the support 15 and the blade 14 will be carried with the drum 10 and moved about the axis M. By connecting the channels 22 to return, thereby permitting the springs 23 to displace the pistons 17 to the left, the ring 19 can be released while the ring 25 can again be brought into locking engagement with the flange 26.

I claim:

1. Apparatus for use in selectively coupling a rotatable blade support to an associated cutting drum of a mineral mining machine to re-position the blade in relation to the drum; said apparatus comprising hydraulic piston and cylinder units rotatable with the blade support and connected to friction means drivably engageable with the drum, wherein compression springs bias the units to maintain the friction means released from the drum and the units are operable under the action of hydraulic force to oppose the biasing force of the compression springs and urge the friction means in driving engagement with the drum to couple the blade support thereto to effect repositioning of the blade.

2. Apparatus for use in selectively coupling a rotatable blade support to an associated cutting drum supported on a mineral mining machine to re-position the blade in relation to the drum; said apparatus comprising hydraulic piston and cylinder units rotatable with the blade support and provided with piston rods connected to opposed first and second friction means, the first friction means being drivably engageable with the drum and the second friction means being engageable with the drum support, spring means which act to bias the piston rods to hold the second friction means against the drum support while the first friction means is free from the drum and working chambers in said units which serve to receive hydraulic pressure fluid which acts to displace the piston rods against the force of the spring means to release the second friction means from the drum support and to cause the first friction means to drivably engage on the drum when re-positioning of the blade is desired.

3. Apparatus according to claim 2, wherein the piston and cylinder units are disposed within the blade support.

4. Apparatus according to claim 3, wherein compression springs constituting the spring means are located within the cylinders of the units and engage on the piston thereof.

5. Apparatus according to claim 2, wherein compression springs constituting the spring means are located within the blade support.

6. Apparatus according to claim 2, wherein the friction means are in the form of rings.

7. Apparatus according to claim 2, wherein the friction means are similar and interchangeable.

8. Apparatus according to claim 2, wherein the first and second friction means are engageable on flanges on the drum and the drum support, respectively.

9. A mineral winning machine provided with a cutting drum supported for rotation on a pivotable support member, a blade which serves to assist in the loading of mineral detached by the drum, a support for the blade which is pivotable about the axis of rotation of the drum to position the blade in relation to the drum, piston and cylinder units formed at least partly within the blade support, the units having pistons and piston rods projecting outwardly from the pistons towards both the drum support member and the drum, rings provided at the ends of the piston rods, springs in the units which bias the pistons to bring one of the rings into clamping contact with the drum support member while the other ring is free from contact with the drum and working chambers in the units which serve to receive hydraulic pressure fluid which acts to displace the pistons against the force of the springs to free the one ring from the drum support and cause the other ring to drivably engage with the drum so that the drum will move the blade support about the rotational axis of the drum to re-position the blade.

* * * * *